US009797564B2

(12) United States Patent
Pijlman et al.

(10) Patent No.: US 9,797,564 B2
(45) Date of Patent: Oct. 24, 2017

(54) LIGHTING UNIT, ESPECIALLY FOR ROAD ILLUMINATION

(71) Applicant: Philips Lighting Holding B.V., Eindhoven (NL)

(72) Inventors: Fetze Pijlman, Eindhoven (NL); Floris Maria Hermansz Crompvoets, Bunde (NL); Arno Vredenborg, Utrecht (NL); Robert Van Asselt, Valkenswaard (NL); Maarten Van Lierop, 'S-Hertogenbosch (NL); Peter Tjin Sjoe Kong Tsang, Eindhoven (NL); Hendrik Jan Eggink, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/031,238

(22) PCT Filed: Oct. 15, 2014

(86) PCT No.: PCT/EP2014/072070
§ 371 (c)(1),
(2) Date: Apr. 21, 2016

(87) PCT Pub. No.: WO2015/062863
PCT Pub. Date: May 7, 2015

(65) Prior Publication Data

US 2016/0273721 A1 Sep. 22, 2016

(30) Foreign Application Priority Data

Oct. 29, 2013 (EP) ..... 13190572

(51) Int. Cl.
*F21V 7/00* (2006.01)
*F21S 8/08* (2006.01)
(Continued)

(52) U.S. Cl.
CPC ..... *F21S 8/086* (2013.01); *F21V 5/002* (2013.01); *F21V 5/005* (2013.01); *F21V 7/00* (2013.01);
(Continued)

(58) Field of Classification Search
CPC ..... F21S 8/086; F21V 5/002; F21V 5/005
See application file for complete search history.

(56) References Cited

U.S. PATENT DOCUMENTS 2,551,954 A 5/1951 Lehman
5,195,818 A * 3/1993 Simmons ..... F21S 8/00 362/224
(Continued)

FOREIGN PATENT DOCUMENTS

CN 100476289 C 4/2009
GB 20120020078 A 8/1982
(Continued)

*Primary Examiner* — Evan Dzierzynski

(57) ABSTRACT

A lighting unit comprising a tapering cavity surrounded by a circumferential reflective wall and extending between a light emission window and a light entrance surface where a light source is (to be) mounted. An optical plate having a light outcoupling structure is provided at the light emission window for redirecting and issuing light as a uniform lighting unit light beam. Said uniform lighting unit light beam has a first beam emission angle β in a first direction and optionally, for example for a rectangular shaped light emission window, a second beam emission angle γ in a second direction transverse to the first direction. The tapering cavity having a first cut-off angle α in said first direction, wherein $\beta=\alpha+2*\delta$ with $0°<\delta<=10°$, and optionally a second cut-off angles ϵ in the second direction transverse to the first direction wherein $\gamma=\epsilon+\Theta$ with $0°<=\Theta<=10°$.

18 Claims, 4 Drawing Sheets

(51) Int. Cl.

| | |
|---|---|
| ***F21V 5/00*** | (2015.01) |
| ***F21V 13/04*** | (2006.01) |
| *F21W 131/103* | (2006.01) |
| *F21Y 105/10* | (2016.01) |
| *F21Y 115/10* | (2016.01) |
| *F21Y 101/00* | (2016.01) |

(52) U.S. Cl.
CPC ..... *F21V 13/04* (2013.01); *F21W 2131/103* (2013.01); *F21Y 2101/00* (2013.01); *F21Y 2105/10* (2016.08); *F21Y 2115/10* (2016.08)

(56) References Cited

U.S. PATENT DOCUMENTS

| | | | | |
|---|---|---|---|---|
| 5,997,156 | A | 12/1999 | Perlo et al. | |
| 7,578,605 | B1 | 8/2009 | Mullins et al. | |
| 7,712,929 | B2 * | 5/2010 | Schaefer | F21V 7/005 362/297 |
| 2007/0263388 | A1 | 11/2007 | Lai et al. | |
| 2011/0019404 | A1 | 1/2011 | Chien et al. | |
| 2012/0020078 | A1 | 1/2012 | Chang | |
| 2013/0201690 | A1 | 8/2013 | Vissenberg et al. | |

FOREIGN PATENT DOCUMENTS

| | | | |
|---|---|---|---|
| JP | 2007311178 | A | 11/2007 |
| WO | 2007111547 | A1 | 10/2007 |
| WO | 2012141899 | A1 | 10/2012 |

* cited by examiner

LIGHTING UNIT, ESPECIALLY FOR ROAD ILLUMINATION

CROSS-REFERENCE TO PRIOR APPLICATIONS

This application is the U.S. National Phase application under 35 U.S.C. §371 of International Application No. PCT/EP2014/072070, filed on Oct. 15, 2014, which claims the benefit of European Patent Application No. 13190572.1, filed on Oct. 29, 2013. These applications are hereby incorporated by reference herein.

FIELD OF THE INVENTION

The invention relates to a lighting unit, especially for road illumination.

BACKGROUND OF THE INVENTION

The use of LEDs in street lighting is known in the art. For instance,

U.S. Pat. No. 7,578,605 describes a reflector system having two-axis control through which beam collimation and wide-angle beam overlapping occur, and a method of manufacturing such a system through cutting flat reflective sheeting and forming the resultant flat parts into the three-dimensional reflectors that collect and shape the light from solid state LEDs, wherein each axis may be customized by changing the cutting and bending of the flat pieces. Especially, this document describes a streetlight application with an exemplary lighting module assembled within a luminaire, whereby light rays extend longitudinally and rays extend in the transverse direction.

SUMMARY OF THE INVENTION

At present most LED luminaires consist of a LED (light emitting diode) array which is shaped by optical means being lenses, MLO (micro lens optics) plates, or reflector cups. In a substantial amount of applications the brightness needs to be reduced beyond a certain angle. Examples are office lighting and road lighting in which this angle is around 60 or 70 degrees (cut-off angles), respectively.

However, in quite a number of applications one would like to prefer a substantial amount of light under angles for illumination purposes, e.g. uniformity, that are actually also reducing comfort. In office lighting one would like to produce a substantial amount of light at an angle of more than 60 degrees from a normal of the ceiling. Such light is known for proper face illumination (for during meetings). In road lighting one encounters a similar situation. Superior luminance uniformity can be obtained by angles more than 70 degrees from the pole. However, this light creates substantial annoyance and should be suppressed to a certain limit. Although in some legislation only intensity is mentioned, brightness does also play an important role for comfort.

Yet another problem that is seen in both mentioned applications is the so-called spottiness of LEDs. In both applications it is popular to use an array of LEDs of which the light is controlled by an MLO plate or a lens array. This often leads to local high brightness peaks on the light emission window. Although the average brightness over the light emission window may be tolerable, the local peaks may not be.

Hence, there is a desire to overcome at least one of the problems of amongst others (i) reduction of brightness at a certain angle while maintaining intensity, (ii) removal of visual spottiness of LEDs, and (iii) making the system less LED dependent. It is further a desire to provide a careful construction of an angular light distribution in a limited volume. Hence, it is especially an aspect of the invention to provide an alternative lighting unit, which preferably further at least partly obviate one or more of above-described drawbacks and/or problems and/or meets one or more of above-mentioned desires.

Herein, it is amongst others proposed to use a light emission window which does not only reduce brightness but may also reduce the spottiness of the LEDs.

Hence, in a first aspect, the invention provides a lighting unit comprising:

- a tapering cavity surrounded by a circumferential reflective wall, the cavity extending between a light entrance surface and a light emission window, the light entrance surface being essentially fully covered or is to be essentially fully covered by a light source;
- light source holding means provided adjacent or at the light entrance surface for accommodating the light source generating light source light during operation;
- an optical plate having a light outcoupling structure/plurality of micro-sized elements provided at the light emission window for redirecting light source light to be issued as a redistributed lighting unit light beam along an optical axis, said redistributed lighting unit light beam having a beam emission angle $\beta$ in a first direction,
- the tapering cavity having a first cut-off angle $\alpha$ in said first direction, wherein $\beta=\alpha+2*\delta$ with $0°<\delta<=15°$, preferably $1°<=\delta<=5°$, and with $65°<=\beta<=165°$,
- the light source has a size S1 in the first direction and the cavity has a height H in the direction along the optical axis, each micro-sized element has a respective dimension Dn in the first direction with 0.01 mm<=Dn<=Dmax, wherein Dmax, H and S1 being mutually related according to H>=3*S1 and Dmax<=1*S1.

The expression "between" in the claim means to express that the cavity does not extend beyond the light entrance surface and the light emission window. Furthermore, the expression "the light entrance surface being essentially fully covered by a light source" means to express that the circumferential reflective wall forms the perimeter of the light entrance window. The perimeter of the light emission window preferably is also formed by the circumferential reflective wall, i.e. the light emission window is bordered by the circumferential reflective wall. $\delta$ is called the broadening angle, i.e. the angle by which the cut-off angle $\alpha$ is twice broadened to become the beam top angle $\beta$, particularly or preferably this broadening is established by micro-sized elements of the outcoupling structure that are located relatively close to the circumferential wall. The cut-off angle of the cavity is to be understood as the angle over which any part of the light source or light entrance surface if the light source is not yet mounted, is directly visible through the light emission window, hence the angle over which the light source/light entrance surface is not fully screened from direct view by the circumferential wall. In known lighting units the shape, i.e. emission beam angle, of the light beam is either determined by the shape, i.e. the cut-offangle, of the tapering cavity as built-up by the size and position of the light source, circumferential wall, in which case the top angle $\beta$ of the beam and the cut-off angle $\alpha$ of the tapering cavity are essentially identical, i.e. $\delta=0°$, or the light beam as shaped by the light source and circumferential wall of the tapering cavity is significantly broadened by a diffusing optical plate provided in the light emission window resulting in $\delta$ being significantly larger than 15° and enhancing the risk of glare due to light being issued in undesired directions. Thus a reduction of brightness at a certain angle while maintaining intensity is realized. Especially in a dark environment, a direct view of the light sourcse is disturbing to the human eye as it is likely to cause glare, yet a wide beam issued by the lighting unit is desirable to allow a relatively large distance between adjacent lighting units to reduce installation costs and yet have a sufficient uniform illumination of a target area. It appeared that with $\delta<=15°$ a good balance between avoiding direct view of the light source and a sufficient broad redistributed lighting unit light beam is obtained. Even better results in this respect are obtainable for $\delta<=5°$, yet $\delta$ should be larger than 0°, preferably larger than 1° to obtain a minimal desired reduction in installation costs. For practical reasons of functionality $\beta$ is in the range of 65° to 165°.

Frequently, the light source of the lighting unit is a non-point light source, i.e. it has a specific size S. This implies that any micro-sized element of the outcoupling structure that is designed to redirect impinging light into a specific direction receives light from the light source from different directions. To enable sufficiently accurate tweaking/reshaping of the beam via redirection by said micro-sized elements, dimensional requirements are imposed on the relationship between size of the light source, size of the micro-sized elements and the (minimal) distance between said light source and the micro-sized elements, which in most cases corresponds to the height of the cavity. Thereto, an embodiment of the lighting unit is characterized in that the lighting unit comprises a light source at the light entrance surface, wherein the light source has a size Sm in a direction in the plane of the light entrance surface, which in the case of the first direction usually corresponds with a direction transverse to the optical axis, and the cavity has a height H in the direction along the optical axis, each micro-facet having a dimension Dn in a direction transverse to the optical axis with 0.01 mm<=Dn<=Dmax, wherein Dmax, H and S being mutually related according to H>=3*Sm and Dmax<=1*Sm. A lighting unit fulfilling these dimensional restrictions appears to generate sufficiently accurately reshaped/redirected light beams. Additional calculations have shown that a matrix of 12*40 facets is sufficient to reach in ME1 light distribution. ME1 currently is the highest European road classification that represents the most demanding properties concerning the light distribution to be rendered by the luminaire.

The lighting unit of the invention may advantageously be used for illumination of a road, the length direction of the road then corresponds with the first direction of the lighting unit, in particular since glare is effectively counteracted by the absence of light being issued into undesired directions. Especially lighting units with a rectangular formed light emission window, preferably a rectangular form with a length to depth aspect ratio in a range of 1.5 to 7, preferably in a range of 4 to 5.5, and mounted with their largest dimension of the rectangle in the length direction of the road, may advantageously be used for illumination of a road. Within the range of this aspect ratio the size of the optics, i.e. the reflector and optical plate, can be reduced rendering the lighting unit to be cheaper. For analogous reasons, an embodiment of the lighting unit is characterized in that the lighting unit comprises a built—in light source, said built-in light source in projection along the optical axis having a light source length to light source depth aspect ratio in a range of 1.5 to 15, preferably in a range of 3 to 10. Furthermore, in particularly for application in road illumination, the ratio in surface of the surface of the light emission window and the light source preferably is in the range of 25 to 500 as then sufficient intensity at high angles is obtained in the illumination of the target area, i.e. the road. High angles in this respect mean angles over 50° with the optical axis.

The outcoupling structure generally comprises micro-sized elements, like micro-prisms and/or micro-facets. In the method for the design of the outcoupling structure the shape and orientation of each micro-sized element is calculated taking into account input parameters like the size of the light source, the distance and mutual position between the light source and the micro-sized element, and the (virtual) target area to be illuminated. To each micro-sized element a part of the target area is assigned. As a start, the first micro-sized element it is set such that its assigned target sub-area is illuminated. However, due to the size of the light source and some reflections distortion of the ideal situation occurs and also some other parts of the target area are (unintentionally) illuminated. By setting the second micro-sized element, this distortion is taken into account, and its setting is adjusted accordingly. This iterative process continues to go on in setting the remainder of the micro-sized elements so that in the end the whole target area is relatively uniformly illuminated.

In particular when the lighting unit is to be applied in applications with a directionality, i.e. the desired beam shape in the first direction is different from the desired beam shape in the second direction, for example as can be advantageously applied in the abovementioned illumination of a road. Hence, an embodiment of the lighting unit is characterized in that said redistributed lighting unit light beam has a second beam emission angle $\gamma$ in a second direction transverse to the first direction and the tapering cavity has a second cut-off angle $\epsilon$ in the second direction transverse to the first direction, wherein $\gamma<=\epsilon+\Theta$ with $0°<=\Theta<=20°$, preferably $1°<=\Theta<=10°$. It is thus enabled to generate an elongated light beam, for example a light beam with a batwing light distribution along the length direction of the road.

Embodiments of the lighting unit are characterized in that $\alpha$ is in the range of $100°<=\alpha<=160°$, and/or in that $\epsilon$ is in the range of $30°<=\epsilon<=65°$. Lighting units with these characteristic shapes of the beam of light source light, and hence (indirectly) a related shape of the cavity, are particularly suitable for road illumination. With the present lighting unit, assuming a plurality of LEDs or LED-dies to be the light source, light may be distributed over a long strip, without substantially suffering from spottiness or undesired brightness. Further, the invention may provide two step optics making the system less LED dependent.

Hence, the lighting unit may especially be applied for illumination of roads. However, other applications than road illumination, are not excluded, like applications selected from the group consisting of an office lighting system, a household application system, a shop lighting system, a home lighting system, an accent lighting system, a spot lighting system, a theater lighting system, a fiber-optics application system, a projection system, a self-lit display system, a pixelated display system, a segmented display system, a warning sign system, a medical lighting application system, an indicator sign system, a decorative lighting system, a portable system, an automotive application, and a greenhouse lighting system. The term "road" herein may amongst others (also) refer to a way, a motorway, an avenue, an alley, a boulevard, a byway, a drive, an expressway, a highway, lane, a parking lot, a parkway, a passage, a pathway, a pavement, a pike, a roadway, a route, a street, a subway, a terrace, a thoroughfare, a throughway, a thruway, a track, a trail, a turnpike, a viaduct, etc. It especially refers to any entity on which a vehicle may propagate, and which entity has for instance an aspect ratio >1, especially >>100. However, the lighting unit of the invention may also be used for illumination or large areas like a parking, a square, an open place, a stadium, etc. In dependence of the application of the lighting unit other, adapted, shapes of the light emission window and/or light source are envisaged, for example in a projection along the optical axis the light emission window and/or light source could have a triangular, square, rectangular, polygonal, round or elliptical form.

A further advantage of the lighting unit of the invention is that in principle any light source may be applied, for example a high pressure mercury gas discharge lamp or a halogen incandescent lamp, but especially any LED light source. Therefore, a further advantage is that the light source may be replaceable or provided separately from the lighting unit and built-in at a later stage. Alternatively, the lighting unit comprises as the light source comprises a pre-built-in array of LEDs or LED-dies. This has the advantage that light source, circumferential wall and outcoupling structure are already aligned, thus reducing the risk on glare due to not fully correct mounting.

In an embodiment, the light source comprises a solid state LED light source (such as a LED or laser diode). The term "light source" may also relate to a plurality of light sources, such as 2-5000, like 2-200, such as 10-200, like 20-200 or 2-20 (solid state) LED light sources. Hence, the term LED may also refer to a plurality of (solid state) LEDs. The light source is especially configured to generate visible light. This may be white light or may be colored light. Hence, in an embodiment, the light source unit comprises a solid state LED (light emitting diode). The lighting unit may comprise a plurality of light source units, such as 2-5000, like 2-200, such as 10-200, like 20-200 or 2-20. Further, a light source unit may comprise a plurality of light sources. Optionally, the plurality of light sources shares a single collimator. The light source unit is further described below. The light source may be a nonpoint light source. A nonpoint light source may be defined as a light source that is sufficiently large in size and close enough to a viewer to appear as an illuminated surface rather than a star-like point of light. For instance, a LED light source may be applied that has a die with a die area larger than 0.5 $cm^2$, such as a die area larger than 1 $cm^2$, such as even equal to or larger than 2 $cm^2$. Especially, when a nonpoint light source, such as with a die area larger than 0.5 $cm^2$, for example a circular die with a diameter in the range of 20 to 50 mm, is applied, the light source unit could but may not necessarily comprise a collimator.

The lighting unit may comprise further elements, like a control, a power source, a sensor, etc., as will be clear to a person skilled in the art.

The lighting unit comprises a cavity. This can be seen as light chamber, which it at least partly enveloped by the light emission window. The cavity is a hollow item (or hollow body, in general of a plurality of enveloping pieces, for example the circumferential wall), which receives the light source light. In other words, the light source unit is configured to provide light source light in the cavity. In an embodiment, the cavity contains at least part of the light source unit. Especially, substantially the entire cavity is enveloped by (i) the light emission window, (ii) the light entrance surface where the light source unit(s) or means for accommodating the light source unit(s) are provided, and (iii) a circumferential wall functioning as a reflector. Note that the term reflector may also refer to a plurality of reflectors. In other words, the cavity is enveloped by an envelope, which may at least comprise the light emission window and a part for accommodating the light source unit(s) (herein also indicates as support (further) comprising one or more light source units), and another part, the latter part especially being reflective. Hence, part of the cavity may be enclosed by a reflector. Note that the support may also be reflective or comprise reflective parts. As the cavity is enveloped, the cavity is a (substantially) closed unit, with at least one part transmissive for light (i.e. the light emission window). Especially, the remainder of the envelope is reflective. The term "reflective" herein especially indicates reflective for visible light.

As indicated above, the light emission window is configured to allow transmission of at least part of the light source light as a beam of light, with the light emission window comprising an optical plate with an upstream face or inner face and a downstream face or outer face, with the upstream face directed to the light entrance surface. The latter may be directly perceived by an observer of the lighting unit, especially when the lighting unit is in operation. The upstream face envelopes thus at least part of the cavity. The downstream surface faces outwards and generally is smooth to enable easy cleaning.

The upstream face comprises light outcoupling structures, i.e. the outcoupling structure faces towards the light entrance surface, which are configured to couple the light source unit light via the light emission window out of the lighting unit. This may especially imply that light from the light source unit travelling through the lighting unit cavity impinges on the light outcoupling structure, penetrates the light outcoupling structure and (the rest of) the light emission window and is issued from the light emission window via the downstream face thereof. Especially, the light outcoupling structures may comprise micro-sized elements light outcoupling structures, such as micro-prisms or micro-facets. In this way, generally via refraction, but optionally via total internal reflection (TIR), redirection of light rays occurs and the light may leave the light outcoupling structure(s) and the light emission window, and contribute to the beam downstream of the light emission window. Especially, a substantial part of the upstream face comprises these light outcoupling structures. For instance, at least 30%, but preferably at least 60%, or even 100% of the light emission window may comprise such light outcoupling structures. These light outcoupling structures may have dimensions in the range of 0.001 cm-1 cm, such as 0.05 mm-5 mm, like 0.1-3 mm. Here, the term "dimensions" especially relates to length, width or diameter of a single micro-sized element of the outcoupling structure, for example a single micro-facet. Especially, the light outcoupling structures are faceted, and/or have faces, like prisms, such as triangular prisms and/or tetrahedral prisms, which have edges having lengths within the indicated ranges. Hence, in an embodiment, the light outcoupling structures comprise prismatic structures. The light outcoupling structures, such as prismatic structures, may be elongated, especially in a direction perpendicular to the cross-sectional plane (and especially parallel to a longitudinal axis of the lighting unit, see further below). The light outcoupling structures, such as micro-sized prisms or micro-sized facets, may have varying pitches and/or varying angles. The pitches may e.g. be in the range of about 0.001-1 cm, such as 0.05-0.5 cm, like 0.1-0.3 cm.

Furthermore, it appeared that the lighting unit having said outcoupling structures having micro-sized elements with a refractive facet surface and a connection surface extending along the optical axis, light rays can interact with said connecting surface, causing redirection of light rays to possibly undesired directions, which thus could cause glare. Said interaction needs not to be problem in directions in which the light beam is symmetrical, as these connecting surfaces lead to a light distribution that is more or less symmetrical as well. Said interaction for micro-sized elements not directly opposite the light source depends a.o. on the orientation of the micro-sized element, i.e. whether if the refractive facet surface is facing towards the light source or if the connecting surface is facing towards the light source. In the case that the refractive facet surfaces faces towards the light source, light rays impinging on said surface that are at an acute angle with the plane of the light emission window are pushed further sideward, i.e. said light rays leave the light emission window at an even larger angle with the normal to the light emission window. Hence, thus is attained that the cut-off angle $\alpha$ (and/or $\epsilon$) of the light beam as would be obtained from the tapering cavity without the optical plate, is broadened with broadening angle $\delta$ (and/or $\Theta$). In the case the connecting surface faces towards the light source, generally collimation is attained of light rays impinging on the refractive facet surface instead of broadening, and furthermore the risk of sometimes undesired interaction with the connecting surface is increased, for example in the case of asymmetrical beams. Hence, the shape of the tapering cavity and the orientation of the micro-sized elements can be chosen to attain the desired broadening/collimation effect. In the inventive luminaire in general only micro-sized elements directly opposite the light source do not have a connecting surface but have two refractive facet surfaces, i.e. in cross-section said micro-sized elements have a gable roof like shape.

Alternatively or additionally to counteract or at least reduce the possibly negative effect of these connecting surfaces for asymmetrical beams, the outcoupling structure or individual micro-sized elements thereof can be put into a slanted orientation with respect to the light entrance surface/light source. In particular the connecting surfaces are then somewhat tilted with respect to the optical axis, or in other words are somewhat tilted towards the light entrance surface so that they extend in a more radial way away from said light entrance surface. The slanted orientation of the micro-sized elements can be either in the first direction, the second direction or in both the first and second direction.

To preferably limit to an acceptably low level the occurrence of interaction that cause light rays in undesired directions, i.e. particularly in direction in which the light beam is non-symmetrical, certain limitations to the dimensions of the micro-sized elements are preferably applied. Thereto, an embodiment of the lighting unit is characterized in that the micro-sized elements facets have a dimension Dn in a direction transverse to the optical axis and a facet height h along the optical axis with 0.01 mm<=Dn<=10 mm and 0.01 mm<=h<=Dn.

An embodiment of the lighting unit is characterized in that the micro-sized elements are separate, discernable entities forming non-continuous lines with each line comprising a number of said entities. Non-continuous lines in this respect means that facets are practically absent in the second direction, or, if the lines are curved, that facets extending locally perpendicular and along the first direction are practically absent but discernable, i.e. practically only facets/facet surfaces are present that extend (curved) along the second direction. Thus by reducing the amount of slanted and/or vertical facets an improvement in glare reduction and uniformity of light is attained. Even though one can make said slanted/vertical facets "invisible" for the direct incident light, light may still be incident on said facets via reflections from the reflector, thus leading to artifacts. Besides, the discretization of the facets may leads to a discretized light effect on the road which may be annoying in case luminance differences become too large. This problem is at least partly alleviated by changing the prisms into lines. The benefit of lines is that the amount of surface that is not supposed to contribute to the beam formation is minimized while the plate remains thin. One method of transforming a grid of surface normals into prism lines is to use the methods by Brooks and Horn to make a surface fitting the normals. After this surface has been obtained one can obtain the prism lines by taking the division of the surface height with a maximal thickness of a line and only keeping the remainder (or module). The vertical facets that are obtained in this way can be smoothened out depending on the position on the plate and the position of the light source.

Generally, the connecting surfaces extending along the optical axis are hampering the desired redirection of light rays. In addition to the above measures, or alternatively, the interaction of light rays with the connecting surfaces can be (further) limited by avoiding light rays to directly imping on said connecting surfaces. Said directly impinging rays can be avoided by screening said connecting surface from direct view by the refractive facet surface. Thereto, an embodiment of the lighting unit is characterized in that the light entrance surface and the light emission window are mutually tilted at a tilt angle $\phi$, $\phi$ being in the range of $0<\phi<=30°$. Of course the connecting surfaces extending along the optical axis that are directly opposite the relatively large light source cannot be screened from direct view of the light source. Therefore the outcoupling structure may comprise at least two types of micro-sized elements, i.e. micro-sized elements not directly opposite to the light source (or light entrance surface) comprising a refractive surface and a connecting surface, and micro-sized elements directly opposite the light source which have two refractive surfaces (of which at least one also functions as connecting surface).

The term "directly opposite to the light source or light entrance surface" refers to an area of the light emission window (comprising said micro-sized elements) that is intersected by a normal to the plane of the light source and/or light entrance surface.

The terms "upstream" and "downstream" relate to an arrangement of items or features relative to the propagation of the light from a light generating means (here especially a light source), wherein relative to a first position within a beam of light from the light generating means, a second position in the beam of light closer to the light generating means is "upstream", and a third position within the beam of light further away from the light generating means is "downstream".

The term "substantially" may also include embodiments with "entirely", "completely", "all", etc. as will be understood by the person skilled in the art. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices or apparatus herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to an apparatus or device comprising one or more of the characterizing features described in the description and/or shown in the attached drawings. The invention further pertains to a method or process comprising one or more of the characterizing features described in the description and/or shown in the attached drawings.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale, some parts may be exaggerated in size for the sake of clarity.

DETAILED DESCRIPTION OF THE EMBODIMENTS

Figure 1:
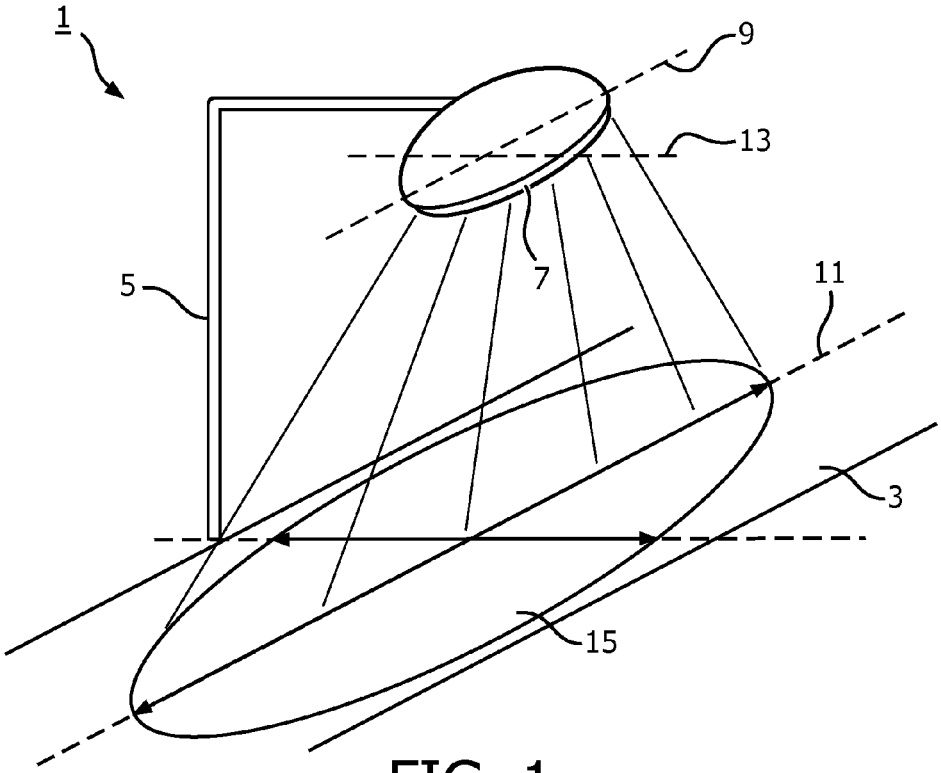
FIG. 1 schematically depicts an application of the lighting unit of the invention for illumination of a road.

FIG. 1 schematically depicts a lighting unit 1 of the invention for illumination of a road 3. The lighting unit is mounted on a pole 5 and has an elliptically shaped light emission window 7, the elliptically shaped light emission window is oriented with its length (or first) direction 9 along the length direction 11 of the road and with its width (or second) direction 13 transverse to the length direction of the road. Thus a specific shape of a lighting unit light beam 14 is generated by the lighting unit rendering an elongated illuminated target area 15 on the road.

Figure 2:
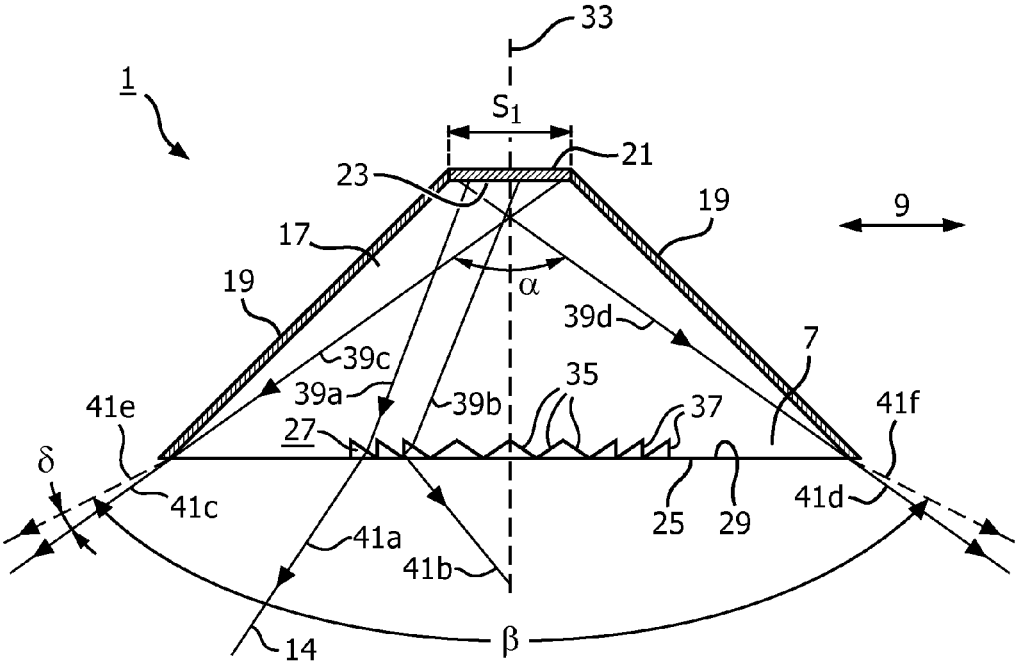
FIG. 2 schematically depicts a cross-section in a first direction of a first embodiment of the lighting unit of the invention.

FIG. 2 schematically depicts a cross-section in a first, i.e. length, direction 9 of a first embodiment of the lighting unit 1 of the invention. The lighting unit has a cavity 17 surrounded by a circumferential light-reflective wall (or reflector) 19 which extends between a rectangular shaped light emission window 7 and a light entrance surface 21. At or alternatively directly adjacent the light entrance surface a light source 23 is mounted, in the figure a plurality of LEDs mounted on a PCB, having a size S1 in the first direction. In the light emission window an optical plate 25 is provided having an outcoupling structure 27 on an inner/upstream surface 29 facing towards the light entrance surface. In the figure the outcoupling structure is a plurality of prisms 31. The plurality of prisms is symmetrically arranged with respect to the light source and an optical axis 33. The prisms each have a refracting surface 35 and a connecting surface 37 which both render impinging light source light rays 39*a,b* . . . , to be redirected as lighting unit light rays 41*a,b* . . . , generally via refraction at the refractive surface and/or via reflection at the connecting surface. Due to the specific symmetrical arrangement of the prisms both the refracted light rays and the reflected rays contribute to the lighting unit light beam without causing glare.

As shown in FIG. 2, the tapering cavity has a first cut-off angle $\alpha$ in said first direction as indicated by non-redirected light rays 39*c,d* and 41*c,d*. Hence, $\alpha$ is the angle over which any part of the light source or light entrance surface (if the light source is not yet mounted) is directly visible through the light emission window, or in other words the angle over which the light source/light entrance surface is not fully screened from direct view by the circumferential wall. The lighting unit issues a lighting unit light beam 14, said light beam 14 has a top angle $\beta$ and most outer light rays 41*e,f*, wherein $\beta=\alpha+2*\delta$, $\delta$ being the broadening angle by which the cut-off angle $\alpha$ is broadened to become beam top angle $\beta$. In the embodiment of FIG. 2 $\delta$ is about 6° and $\alpha$ is about 110°.

Figure 3:
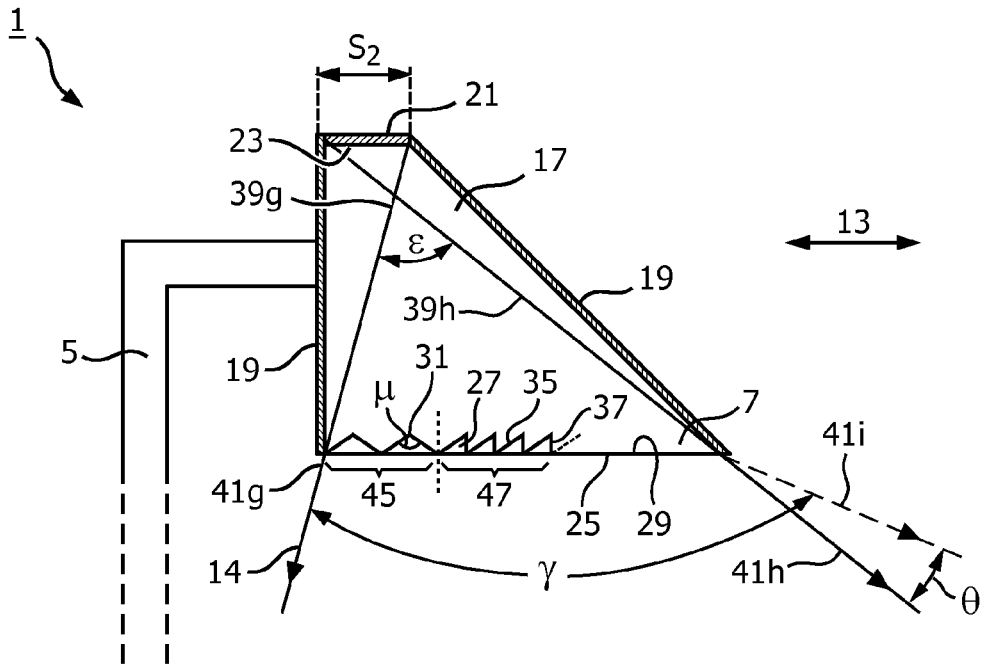
FIG. 3 schematically depicts a cross-section of the lighting unit of FIG. 2 in a second direction.

FIG. 3 schematically depicts mounted on pole 5 a cross-section of the lighting unit 1 of FIG. 2 in a second direction, i.e. width direction 13 of the first embodiment of the lighting unit 1 of the invention. In the light emission window 7 the optical plate 25 is provided having the outcoupling structure 27 on its inner/upstream surface 29 facing towards the light entrance surface 21 where the light source 23 is mounted. The light entrance surface has a size S2 in the second direction, S2 being less or equal to a maximum size Sm of the light entrance surface in any direction in the plane of the light entrance surface. In the figure the outcoupling structure is a plurality of prisms 31 and comprises two groups of prisms. A first group of prisms 45 with a top prism angle $\mu$ of, for example, about 140° directly opposite the light source 23 having only refracting surfaces 35 viewed in this cross-section, and a second group of prisms 47 opposite, but not directly opposite, the light source having both a refractive surface 35 and a connecting surface 37 viewed in this cross-section, the top angle of the prisms of the second group being, for example, in a range between about 15° to about 40°. A similar cross section of the outcoupling structure comprising first and second groups is shown in FIG. 2.

As shown in FIG. 3, the tapering cavity 17 has a second cut-off angle $\epsilon$ in said second direction as indicated by non-redirected light rays 39*g,h* and 41*g,h*. Hence, $\epsilon$ is the angle over which any part of the light source or light entrance surface (if the light source is not yet mounted) is directly visible through the light emission window, or in other words the angle over which the light source/light entrance surface is not fully screened from direct view by the circumferential wall 19. The lighting unit issues a lighting unit light beam 14, said light beam 14 has a top angle $\gamma$ in the second direction transverse to the first direction as indicated by most outer light rays 41*g,i*, wherein $\gamma=\epsilon+\Theta$, $\Theta$ being the broadening angle by which the cut-off angle $\epsilon$ is broadened to become beam top angle $\gamma$. In the embodiment of FIG. 3 $\Theta$ is about 8°.

Figure 4:
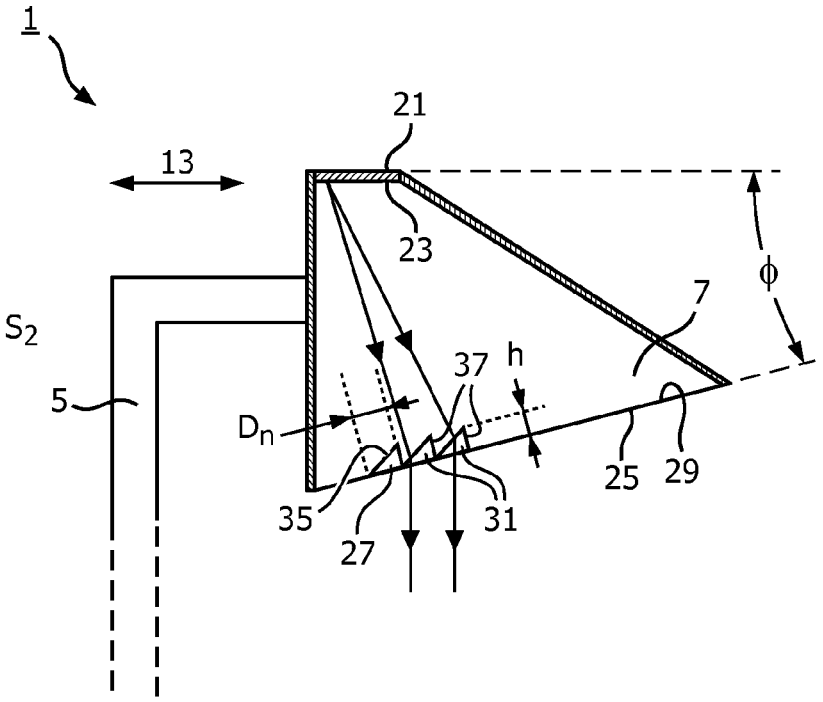
FIG. 4 schematically depicts a cross-section in a second direction of a second embodiment of the lighting unit according to the invention.

FIG. 4 schematically depicts a cross-section in a second direction 13 of a second embodiment of the lighting unit 1 according to the invention as mounted on pole 5. This embodiment of the lighting unit has a light emission window 7 which is in a tilted orientation at a tilting angle $\phi$ of, for example 20°, with respect to both the light entrance surface 21 and the light source 23 mounted in the light entrance surface. The inner surface 29 of the optical plate 25 mounted in the light emission window is provided with an outcoupling structure 27 having micro-sized prisms 31. The possibly negative effect of the connecting surfaces 37 of the micro-sized prisms is thus reduced as the direct exposure of the connecting surfaces to the light source is reduced because of the connecting surfaces extending in a more radial direction away from the light entrance surface. The beneficial effect of tilting is affected by height h and width Dn of the micro-sized prisms and the tilting angle $\phi$.

Figure 5:
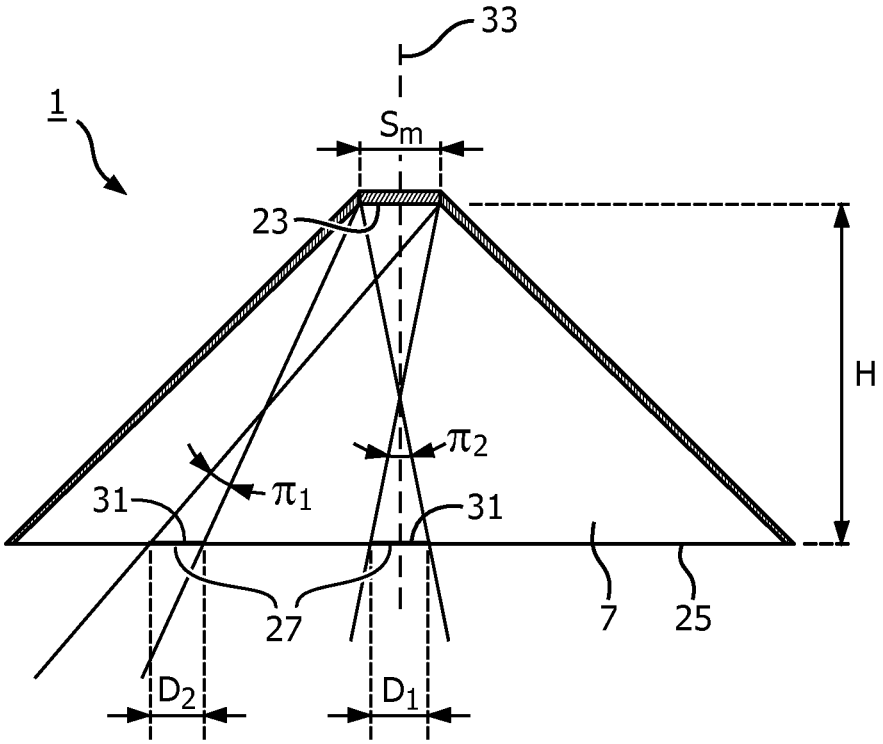
FIG. 5 schematically depicts the relevance of the light source of the lighting unit being a non-point light source.

FIG. 5 schematically depicts the relevance of the light source 23 of the lighting unit 1 being a non-point light source, i.e. has a size Sm measured in a direction transverse to the optical axis 33, in the figure Sm is, for example, about 3.5 cm. The lighting unit has a height H along the optical axis, in the figure H is, for example about 12 cm. The light emission window 7 of the lighting unit is provided with an optical plate 25 provided with an outcoupling structure 27 comprising micro-sized elements 31. Each micro-sized element has a respective dimension Dn transverse to the optical axis, only D1 and D2 are shown for two micro-sized elements and typically both being in this embodiment, for example, in a range of about 1 mm to about 5 mm. The angle $\pi_{1,2}$ between light rays directly received on a single micro-sized element from the light source is mainly determined by the size Sm of the light source and the height H of the lighting unit, or to be more precise the distance between the light source and the micro-sized element, and determined to a less degree by the dimension D of the micro-sized element (as long as D<<Sm) and the position of the micro-sized element with respect to the light source (e.g. in a shifted position or positioned directly opposite the light source). To enable sufficiently accurate tweaking/reshaping of the beam via redirection by said micro-sized elements, the angle $\pi_{1,2}$ should be relatively small. If each micro-facet has a dimension D in a range 0.01 mm<=D<=Dmax, and that Dmax, H and Sm are mutually related according to H>=3*Sm and Dmax<=1*Sm, in the figure D=3 mm, the lighting unit with these dimensional restrictions appears to generate sufficiently accurately reshaped/redirected light beams.

Furthermore, analyses have been done on the minimal dimensions for the light emission window when changing the dimension ratios of the light source in the first and second directions. Some aspects that play a role here are:

The amount of light being sufficiently narrow/elongated on the exit window:

The amount of shielding effect of the reflector/circumferential wall for the outcoupling structure being provided on the upstream/inner wall of the optical plate.

Results of these analyses are shown in the table 1 below for a source having a typical area of 900.

TABLE 1

| wX | wY | H | Lx | Ly | Lx/Ly | $A_{lew}/A_{ls}$ | Intensity level |
|---|---|---|---|---|---|---|---|
| 30 | 30 | 120 | 400 | 120 | 3.3 | 53 | Low |
| 30 | 30 | 140 | 665 | 135 | 4.9 | 100 | High |
| 45 | 20 | 95 | 440 | 90 | 4.9 | 44 | High |
| 60 | 15 | 72 | 330 | 69 | 4.8 | 25 | Low |
| 75 | 12 | 57 | 300 | 55 | 5.5 | 18 | Low |

Wherein:

wX is the length of the source in the first direction, i.e. the direction that is along the length direction of the road;

wY is the width of the source in the second direction, i.e. the direction that is perpendicular to the length direction of the road;

H is the distance between the light source and the light emission window;

Lx and Ly are the dimensions of the light emission window in respectively the first and second direction;

$A_{lew}/A_{ls}$ is the ratio between the surface of the light emission window and the surface of the light source.

Sufficient intensity expresses the possibility of having high intensities at high angles like what is needed for road lighting like ME1. Said high intensity involves that at angles of about 65° an intensity is attained that enables a relatively large pole spacing between adjacent lighting units while maintaining an about equal uniform luminance compared to what is attained with the convention pole spacing using known lighting units. The qualification "low" means it is difficult, and "high" means that there is sufficient intensity available. It is clear that sufficient intensity at high angles is obtained for elongated aspect ratios of the light emission window, for example said ratio Lx/Ly being preferably about 5, in combination with a sufficiently high $A_{lew}/A_{ls}$ ratio, for example $A_{lew}/A_{ls}$>=40.

Figure 6A:
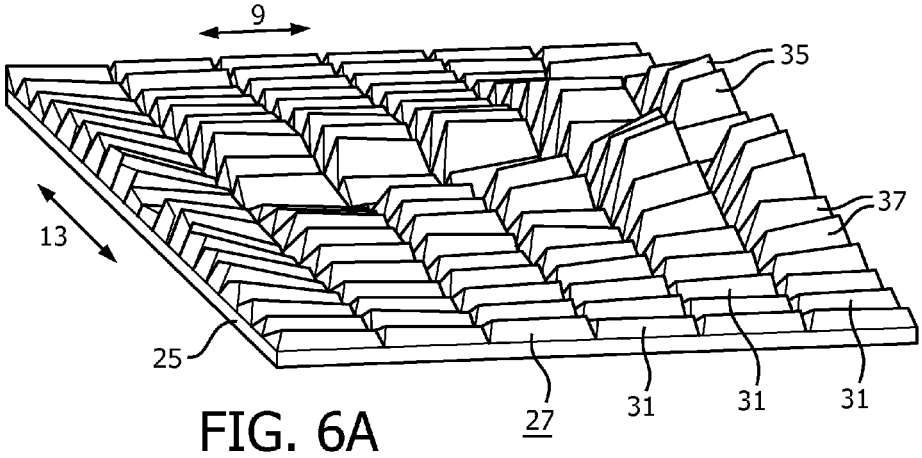
FIG. 6A-B schematically depicts respectively a perspective view and a top view of an outcoupling structure having a slanted orientation of the micro-sized elements.
Figure 6B:
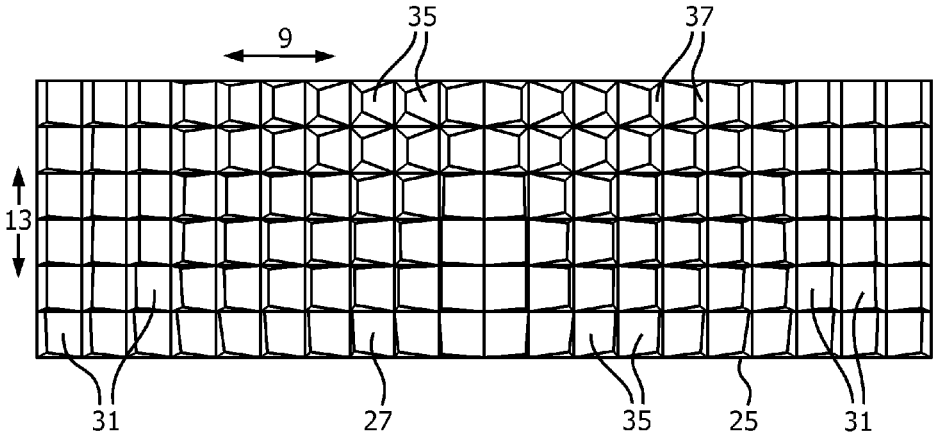

FIG. 6A-B schematically depicts respectively a perspective view and a top view of an optical plate 25 provided with an outcoupling structure 27 having a slanted orientation of the micro-sized elements (prisms) 31. As shown, the micro-sized elements are arranged in columns along the second direction 13 and in rows along the first direction 9. Both the refractive surface 35 and connecting surface 37 of micro-sized elements and their mutual ordering and gradual course in slope are clearly visible.

Figure 7:
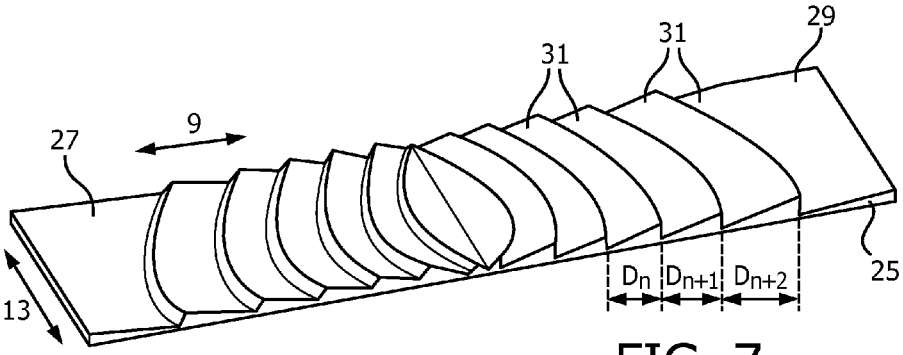
FIG. 7 schematically depicts a line arrangement of micro-sized elements of an outcoupling structure.

FIG. 7 schematically depicts a curved line arrangement of micro-sized elements 31 of an outcoupling structure 27 provided on the upstream/inner surface 29 of the optical plate 25. The curves extend more or less in the second direction 13, each curve has respective micro-sized elements with a respective dimension Dn . . . Dn+2 in the first direction. As shown in the figure, the vertical connecting surfaces are smoothened out alongside the first direction 9, their smoothening being depending on their relative position on the optical plate and the position of the light source (not shown).

The invention claimed is:

1. A lighting unit comprising:

a tapering cavity surrounded by a circumferential reflective wall, the cavity extending between a light entrance surface and a light emission window, the light entrance surface being essentially fully covered or is to be essentially fully covered by a light source;

light source holding means provided adjacent or at the light entrance surface for accommodating the light source generating light source light which, during operation, is to be issued into at least a mutually transverse first and a second direction;

an optical plate having a light outcoupling structure with micro-sized elements provided at the light emission window for redirecting light source light to be issued as a redistributed lighting unit light beam along an optical axis, said redistributed lighting unit light beam having a beam emission angle R in the first direction, the tapering cavity having a first cut-off angle $\alpha$ in said first direction, wherein $\beta=\alpha+2*\delta$ with $0°<\delta<=15°$, preferably $1°<=\delta<=5°$, and with $65°<=\beta<=165°$, the light source has a size S1 in the first direction and the cavity has a height H in the direction along the optical axis, each micro-sized element has a respective dimension Dn in the first direction with 0.01 mm<=Dn<=Dmax, wherein Dmax, H and S1 being mutually related according to H>=3*S1 and Dmax<=1*S1.

2. A lighting unit as claimed in claim 1, wherein in a projection along the optical axis the light emission window and/or the light source has a triangular, square, rectangular, polygonal, round or elliptical form.

3. A lighting unit as claimed in claim 1, wherein the outcoupling structure is facing towards the light entrance surface.

4. A lighting unit as claimed in claim 1, wherein said redistributed lighting unit light beam has a second beam emission angle $\gamma$ in the second direction transverse to the first direction and the tapering cavity has a second cut-off angle $\epsilon$ in the second direction transverse to the first direction, wherein $\gamma=\epsilon+\Theta$ with $0°<=\Theta<=20°$, preferably $1°<=\Theta<=10°$.

5. A lighting unit as claimed in claim 4, wherein $\epsilon$ is in the range of $30°<=\epsilon<=65°$.

6. A lighting unit as claimed in claim 1, wherein the lighting unit comprises a light source at the light entrance surface, wherein the light source has a size Sm in a direction in the plane of the light entrance surface and the cavity has a height H in the direction along the optical axis, each micro-sized element having a dimension Dn in a direction transverse to the optical axis with 0.01 mm<=Dn<=Dmax, wherein Dmax, H and S being mutually related according to H>=3*Sm and Dmax<=1*Sm.

7. A lighting unit as claimed in claim 1, wherein the micro-sized elements have a dimension Dn in a direction transverse to the optical axis and a facet height h along the optical axis with 0.01 mm<=Dn<=10 mm and 0.01 mm<=h<=Dn.

8. A lighting unit as claimed in claim 1, wherein the micro-sized elements not directly opposite the light entrance surface have a refractive facet surface facing towards the light entrance surface, preferably said micro-sized elements are in slanted orientation with respect to the optical axis.

9. A lighting unit as claimed in claim 1, wherein the micro-sized elements not directly opposite the light entrance surface have a refractive facet surface facing away from the light entrance surface.

10. A lighting unit as claimed in claim 1, wherein the micro-sized elements directly opposite the light entrance surface have a gable-roof shaped cross-section formed by two refractive facet surfaces facing towards the light entrance surface.

11. A lighting unit as claimed in claim 1, wherein the micro-sized elements are oriented in a slanted/tilted orientation towards the light entrance surface in the first and/or second direction.

12. A lighting unit as claimed in claim 1, wherein the micro-sized elements are separate, discernable entities forming non-continuous lines with each line comprising a number of said entities.

13. A lighting unit as claimed in claim 1, wherein the light entrance surface and the light emission window are mutually tilted at a tilt angle $\phi$, $\phi$ being in the range of $0<\phi<=30°$.

14. A lighting unit as claimed in claim 1, wherein $\alpha$ is in the range of $100°<=\alpha<=160°$.

15. A lighting unit as claimed in claim 1, wherein in a projection along the optical axis the light emission window has a rectangular form with a length to depth aspect ratio in a range of 1.5 to 7, preferably in a range of 4 to 5.5.

16. A lighting unit as claimed in claim 1, wherein the lighting unit comprises a built in light source, said built-in light source in projection along the optical axis having a light source length to light source depth aspect ratio in a range of 1.5 to 15, preferably in a range of 3 to 10.

17. A lighting unit as claimed in claim 1, wherein the ratio in surface of the surface of the light emission window and the light source is in the range of 25 to 500.

18. A lighting unit as claimed in claim 1, wherein the light source comprises a pre-built-in array of LEDs or LED-dies.

* * * * *